United States Patent [19]

Lisec

[11] Patent Number: 4,886,095

[45] Date of Patent: Dec. 12, 1989

[54] PROCESS AND APPARATUS FOR FILLING AN INSULATING GLASS UNIT WITH FILLER GAS

[76] Inventor: Peter Lisec, Bahnhofstrasse 34, A-3363 Amstetten-Hausmening, Austria

[21] Appl. No.: 144,089

[22] Filed: Jan. 15, 1988

[30] Foreign Application Priority Data

Jan. 15, 1987 [AT] Austria ..... 68/87

[51] Int. Cl.[4] ..... B65B 31/04; B65B 43/42; E06B 3/66

[52] U.S. Cl. ..... 141/4; 141/7; 141/59; 141/66; 141/129; 156/99; 156/102

[58] Field of Search ..... 141/1, 4, 5, 7, 59, 141/65, 66, 95, 96, 83, 129, 370; 156/99, 103, 107, 104, 102

[56] References Cited

U.S. PATENT DOCUMENTS

| | | | |
|---|---|---|---|
| 2,030,869 | 2/1936 | Haven | 141/329 X |
| 2,875,792 | 3/1959 | Moyer | 141/4 |
| 2,875,794 | 3/1959 | Schmertz | 141/4 X |
| 3,683,974 | 8/1972 | Stewart et al. | 141/4 |
| 3,842,567 | 10/1974 | Zwart et al. | 57/403 |

FOREIGN PATENT DOCUMENTS

| | | |
|---|---|---|
| 0046847 | 3/1982 | European Pat. Off. . |
| 8025477 | 1/1981 | Fed. Rep. of Germany . |
| 8025478 | 1/1981 | Fed. Rep. of Germany . |
| 2229523 | 2/1981 | Fed. Rep. of Germany . |
| 3025122 | 4/1982 | Fed. Rep. of Germany . |
| 3117256 | 11/1982 | Fed. Rep. of Germany . |
| 3402323 | 8/1985 | Fed. Rep. of Germany . |

*Primary Examiner*—Ernest G. Cusick
*Attorney, Agent, or Firm*—Young & Thompson

[57] ABSTRACT

When filling the inner space (14) of an insulating glass unit (4) with a filler gas, a pressure is exerted during filling on the outer surfaces of the glass panes (12, 13) of the insulating glass unit (4) to be filled. For this purpose, an apparatus is suggested with a device (5) for feeding filler gas and with a device (6), by which air and/or gas can be removed from the inner space (14) of the insulating glass unit, wherein two pressure plates (1, 2) are provided which can be placed, during the filling step, with a preselectable pressure against the outer surfaces of the glass panes (12, 13) of the insulating glass unit (4).

16 Claims, 1 Drawing Sheet

Fig.1
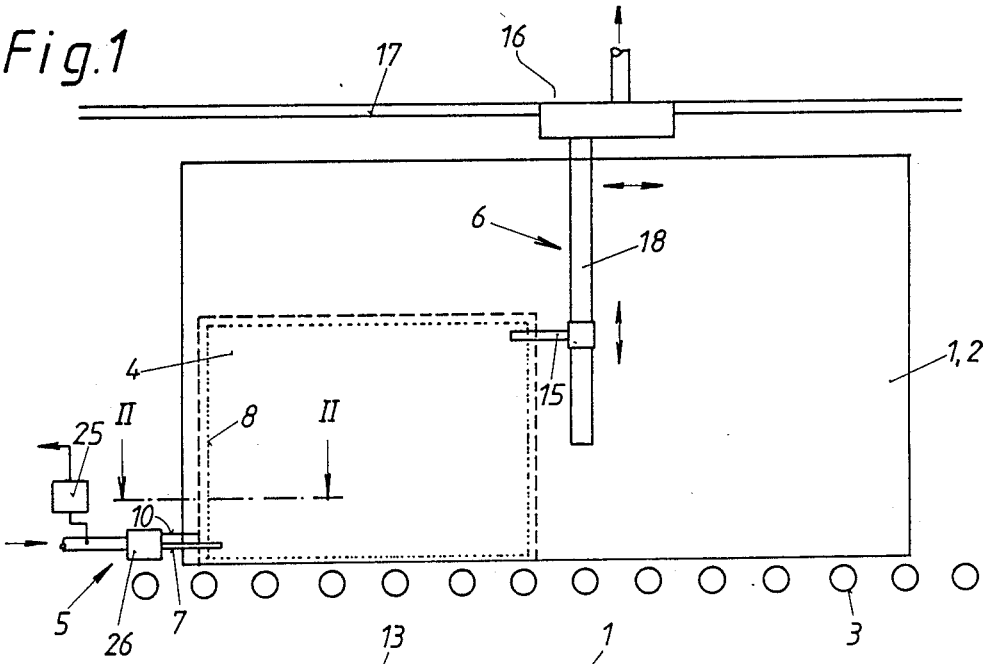
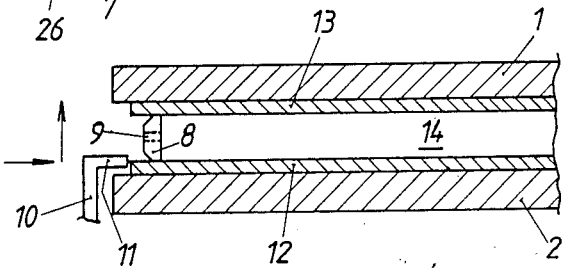
Fig.2
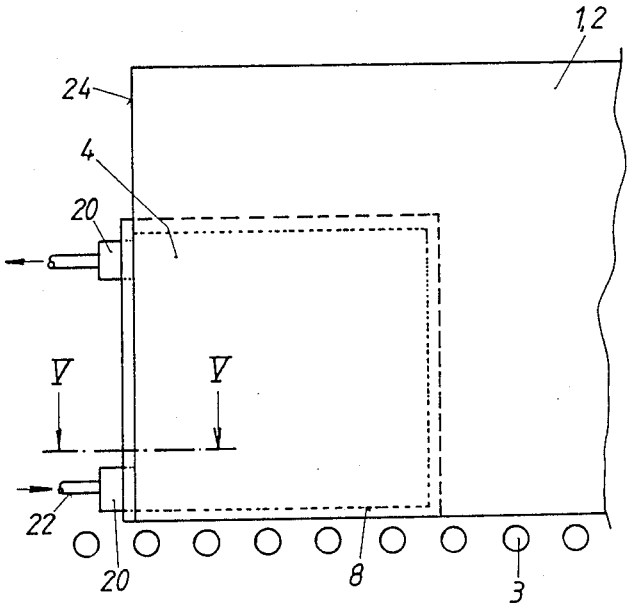
Fig.3
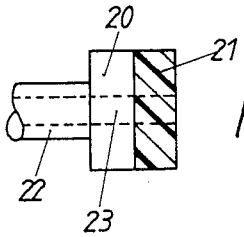
Fig.4
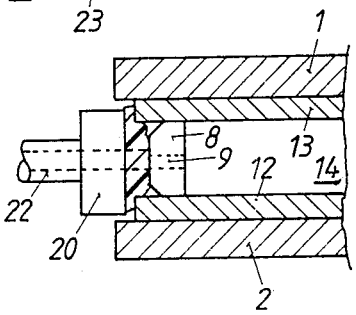
Fig.5

PROCESS AND APPARATUS FOR FILLING AN INSULATING GLASS UNIT WITH FILLER GAS

FIELD OF THE INVENTION

The invention relates to a process for filling an insulating glass unit with a filler gas wherein the filler gas is introduced into the inner space of the insulating glass unit by way of at least one inlet opening, and air and/or air-gas mixture is exhausted, especially by suction, from the interior of the insulating glass unit by way of at least one further opening.

The invention furthermore relates to an apparatus for performing the process, with a device for feeding filler gas into the inner space of an insulating glass unit by way of at least one opening provided in the spacer frame of this unit, and with a device that makes it possible to remove air and/or gas from the inner space of the insulating glass unit by way of at least one further opening provided in the spacer frame of this unit.

DESCRIPTION OF THE RELATED ART

Various processes and contrivances for filling insulating glass with a filler gas have been proposed. Attention is invited, in this connection, to EP-A 46,847, DE-C 30 25 122, as well as the two DE-U 80 25 477 and 80 25 478.

The conventional facilities exhibit the drawback that a long time goes by until the filling step is completed. Therefore, the cycle times (about 20 seconds) customary for insulating glass manufacture can no longer be maintained. The reason for this is that filling of the insulating glass unit with filler gas must take place gradually so that there is no buildup of high pressure within the pane since otherwise the insulating glass unit would be destroyed, for example because the glass panes detach themselves from the spacer frame.

Frequently, filling is continued during the filling of insulating glass units with a filler gas until the oxygen content of the removed gas falls below a predetermined value in the region of the gas outlet point. Therefore, an oxygen sensor must be arranged in the exhaust conduit, resulting in making the facilities even more expensive.

OBJECT OF THE INVENTION

The invention is based on the object of indicating a process of the type discussed above which can be performed quickly and simply so that filling with a filler gas does not interfere with the normal cycle times of an insulating glass manufacturing line.

SUMMARY OF THE INVENTION

According to the invention, this object has been attained by exerting, during the filling step, a pressure on the outer surfaces of the glass panes of the insulating glass unit to be filled which is at least as high as the pressure in the inner space of the insulating glass unit during the filling step.

Due to the step proposed by the invention, the filler gas can be injected into the insulating glass unit at a high pressure and accordingly with a correspondingly high speed; flow rates of 60–200 1/min are possible. Due to the fact that the glass panes are pressed against the spacer frame by the pressure applied from the outside, there is no danger of detachment of the glass panes from the spacer frame. Also, this step prevents spacer frames between the two glass panes of the insulating glass unit from migrating toward the outside under the pressure of the filler gas.

In an especially simple version, the procedure according to the invention involves application of the pressure to the glass panes during the filling step by the placement of plate-shaped pressure elements against the panes.

According to the invention, it is advantageous to determine the volume of the inner space of the insulating glass unit to be filled with the filler gas; to detect the amount of filler gas introduced; and to terminate the filling step once the detected amount of filler gas is equal to the amount of filler gas to be filled into the inner space. Preferably, the procedure herein can be such that the amount of filler gas fed per unit time is determined, and the filling step is interrupted when the product of amount of filler gas per unit time and duration of filling step corresponds to the volume to be introduced into the inner space of the insulating glass unit. In this version, oxygen sensors need not be provided in the exhaust conduit since simply the required amount of filler gas is injected into the insulating glass unit. In this version of the process according to the invention, it proves to be especially advantageous that high gas flow velocities can be utilized so that intermixing of the filler gas with the air to be displaced in the inner space of the insulating glass unit is most extensively avoided.

In order to prevent premature lifting of the pressure exerted on the outer surfaces of the glass panes of the insulating glass unit, it is recommended to proceed in the process of this invention so that, after termination of the filling step, the pressure is measured in the gas feed conduit, and the pressure is lifted on the outer surface of the glass panes of the insulating glass unit only after the thus-determined pressure corresponds to a preselected value, for example atmospheric pressure. This mode of operation also opens up the possibility of building up a preselected pressure in the insulating glass unit to avoid collapsing or bulging of the glass panes of the insulating glass unit at differing manufacturing and installation sites (lower air pressure in case of installation sites of higher elevation and, respectively, higher air pressure at installation sites of lower elevation). For this purpose, the procedure can be to set the pressure of the gas in the interior of the insulating glass to a preselected value, the preselected pressure value corresponding to mean atmospheric pressure at the installation site of the insulating glass.

An apparatus for performing the process, preferred according to this invention, is characterized in that two pressure plates are provided which, during the filling step, can be placed with a preselected pressure into contact with the outer surfaces of the glass panes of the insulating glass unit. When using the apparatus of this invention, the insulating glass unit is brought between the two pressure plates; in this connection, the provision is preferably made that a conveying means, e.g. conveyor rollers or an endless conveyor belt, is provided for the insulating glass unit at the bottom end of the pressure plates that can be brought into contact with the outer surfaces of the glass panes, and thereupon the two pressure plates are brought into contact from the outside against the glass panes of the insulating glass unit. The two pressure plates can be constituted by the platens of a press for press-molding insulating glass. However, this is merely a preferred version, since actually it is sufficient to provide two pressure plates contacting the outer surfaces of the two glass panes of the insulating glass unit and being urged with an appropriate pressure against the glass panes.

In case the device for feeding the filler gas and the exhaust device in the apparatus of this invention are provided with probes that can be introduced into openings (bores) arranged in the spacer frame, then it is advantageous to associate means with the probes which align the probes in each case exactly to the center between the glass panes of the insulating glass unit. The vertical alignment of the probes is predetermined by the position of the opening, produced by a drilling device, punching means, or the like, and ordinarily need not be scanned separately.

If use of probes is not desired, then the provisions can be made according to the invention that the device for feeding filler gas has a block at its end, which block can be applied to the narrow side of the insulating glass unit in the zone of the opening in the spacer; that the block exhibits a layer of an elastic material on its surface facing the insulating glass unit; and that the layer during application of the block comes into sealing contact with the end edges of the glass panes and with the outer surface of the spacer between the glass panes. Additionally or alternatively it is possible to provide that the device has a block at its end, which block can be applied to the narrow side of the insulating glass unit in the zone of the opening in the spacer; that the block exhibits a layer of an elastic material on its surface facing the insulating glass unit; and that the layer during application of the block comes into sealing contact with the end edges of the glass panes and with the outer surface of the spacer between the glass panes. Devices for feeding filler gas and for removing air and/or gas equipped in this way will be used with preference in case the openings for feeding and/or exhausting purposes are arranged in the zone of vertical edges or one vertical edge of the insulating glass unit.

In one embodiment of the apparatus of this invention, the provision can be made that the free end of the device that can be brought into contact with the insulating glass unit is carried by a slide, to be vertically adjustable and horizontally adjustable, this slide being guided above the pressure plates. The thus-mounted exhaust device and/or the block provided at this device and/or, in particular, the probe arranged thereat, are moved into place from above and then laterally inserted in the opening in the spacer, or brought into contact therewith.

According to a further suggestion of the invention the provision is made to arrange a pressure gauge in the conduit for feeding the filler gas. The pressure sensor in the feed conduit for the filler gas detects the pressure prevailing in the inner space of the insulating glass unit and controls the device so that the press is opened only then, or the pressure on the outer surfaces of the glass panes of the insulating glass unit is lifted only when the pressure gauge transmits a signal indicating that the gas pressure in the interior of the insulating glass unit corresponds, for example, to atmospheric pressure (or a preselected pressure). After reaching the desired pressure, the opening in the spacer frame is sealed by injection of a hardening compound, for example with the aid of a plug of butyl rubber. The corresponding desired pressure in the interior of the insulating glass unit can be attained by continuing the operation of the exhausting device (vacuum pump) after cutting off the gas feed until the pressure gauge indicates the correct pressure (e.g. = atmospheric pressure) or another, correspondingly predetermined pressure. This mode of operation also makes it possible to adjust the pressure in the interior of the insulating glass pane to the atmospheric pressure normally ambient at the installation site depending on elevation above sea level of the installation site.

In order to shorten the cycle times, sealing of the openings in the spacer can also be effected in another station.

The mode of operation according to this invention and the apparatus according to the invention also permit to perform an only partial filling of the insulating glass unit with filler gas (e.g. sulfur hexafluoride) desirable for sound insulation purposes. This has previously been unattainable by means of an ordinary oxygen sensor in the exhaust conduit. In case of the invention, it is enough to simply inject the predetermined quantity of filler gas, based on the volume of the inner space of the insulating glass unit (i.e. the desired fraction of the inner space volume).

BRIEF DESCRIPTION OF THE DRAWING

Additional details and features of the invention can be seen from the following description wherein reference is had to the schematic drawing wherein:

FIG. 1 shows a first embodiment of an apparatus according to this invention for filling insulating glass units with a filler gas, FIG. 2 shows a section along line II—II in FIG. 1, FIG. 3 shows another embodiment of an apparatus of this invention in a fragmentary view, FIG. 4 shows a portion of a device for feeding filler gas and/or for exhausting same, and FIG. 5 shows the device of FIG. 4 after attachment to the side rim of an insulating glass unit along the section line V—V in FIG. 3.

DETAILED DESCRIPTION OF THE INVENTION

An apparatus for filling an insulating glass unit with a filler gas, illustrated in FIGS. 1 and 2, comprises two plates 1 and 2 which can be moved toward each other. These plates 1 and 2 are, for example, the pressure platens of a plate press for press-molding insulating glass as known from DE-A 31 30 645. A positioning conveyor 3, constituted in the illustrated embodiment of several rollers, is provided below the bottom rim of the plates 1, 2. The positioning conveyor 3 serves as a transporting means for feeding insulating glass units 4 into the interspace between the two pressure plates 1 and 2.

A device 5 for feeding filler gas and a device 6 for exhausting air and/or gas are associated with the pressure plates 1 and 2. The device 5 is connected to a source of filler gas. The device 6 can be connected to the intake side of a vacuum pump.

The device 5 is movably supported by way of means, not shown in detail, and can be moved forwards toward the insulating glass pane 4 standing between the plates 1 and 2 so that the probe 7 of this device extends through an opening 9 provided in a spacer 8, as shown in FIG. 1. In order to provide lateral alignment of the device 5 for introducing filler gas into the insulating glass unit 4, a feeler 10 is connected with the device 5 and is in contact via an extension 11, in the starting position, against the end edge of one of the two glass panes 12 and 13 (the glass pane 12 in the embodiment shown in FIG. 2) of the insulating glass unit 4. The feeler 10 is then moved toward the other glass pane 13, i.e. transversely to the plane of the insulating glass unit 4, the extension 11 moving into the groove formed between the rims of the glass panes 12 and 13 and the spacer 8, until the extension finally abuts against the inside of the glass pane 13. The stroke between penetration into the marginal groove and abutting of the finger 11 against the glass pane 13 corresponds to the thickness of the inner space 14, so that the middle of the distance between the two inner surfaces of the glass panes 12 and 13 can be determined by calculations. In this way, the probe 7 can be centrally aligned in the lateral direction with respect to the opening 9. The vertical alignment need not be executed separately since the height of the tool (drill or punch) producing the opening is predetermined anyway with respect to the lower horizontal edge of the insulating glass unit 4.

A similar lateral alignment is provided for the probe 15 of the device 6. The device 6 comprises a slide 16 movable on a rail 17 mounted above the plates 1, 2. The probe 15 is carried to be displaceable upwards and downwards by an arm 18 of the device 6 which extends to in between the plates 1 and 2. Drive mechanisms, e.g. chains or rope drives, or also pressure medium motors, are provided for moving the device 6 and the probe 15; these drive mechanisms are not shown in detail.

In the embodiment shown in FIGS. 3-5, the two pressure plates 1 and 2 and the positioning conveyor 3 for an insulating glass unit 4 are again included. Instead of the probes 7 and 15, respectively, the device 5 and the device 6, respectively, exhibit blocks 20 that can be made to engage the insulating glass unit 4; these blocks have layers 21 of an elastically resilient material, for example foam material, on their sides that are to face the insulating glass units. The block 20 as well as the layer 21 are penetrated by a bore 23 coaxial with the feed conduit 22. The bore, with the block 20 having been brought into contact with the insulating glass unit 4, is in alignment with the opening 9 in the spacer 8 of the insulating glass unit 4. Upon engagement of the block 20 against the end face of an insulating glass unit 4, the layer 21 of the block 20 is deformed and sealingly contacts the end rims of the glass panes 12 and 13 as well as the outer surface of the spacer 8 so that even without a probe 7 or 15 a gas-tight connection of the device 5 and the device 6, respectively, with the inner space 14 of the insulating glass unit 4 is attained.

In FIG. 5, the alignment of the insulating glass unit 4 with respect to the pressure plates 1 and 2 is modified as compared with the illustration of FIG. 3. The alignment according to FIG. 3 is preferred, wherein the insulating glass unit 4 projects somewhat beyond the vertical side edge 24 of the plates 1 and 2. In this case, the block 20 can be designed to be broader, and, differently from the embodiment of FIG. 5, it is possible to perform, with a uniform block 20, the filling and/or exhausting steps with insulating glass units of varying thicknesses. It can also be seen from FIG. 1 that the device for feeding filler gas into the insulating glass unit 4 is associated with a pressure gauge 25 and a flowmeter 26. Although this is not illustrated in the example of FIG. 3, the aforementioned measuring instruments are also included in this embodiment. The flowmeter measures either the total quantity of filler gas fed by the device 5, or, alternatively, the amount of filler gas introduced per unit time via the filling device 5.

When using the apparatus of this invention, the filling volume, i.e. the volume of the inner space 14 of the insulating glass unit 4 to be filled, can be calculated (based on the breadth and height of the insulating glass unit 4 in conjunction with the spacing of the two glass panes 12 and 13 previously determined by the feeler 10). The required amount of filler gas is determined on the basis of the thus-determined volume. The procedure then can be such that, based on the quantity of filler gas flowing per unit time, measured by the flowmeter, the filling step is broken off after a predetermined time span, the predetermined time span corresponding to the volume of filler gas to be fed, based on the flow velocity. The volume of filler gas to be introduced normally corresponds to 110-120% of the volume of the inner space 14 of the insulating glass unit 4.

In order to preclude excess pressure or subatmospheric pressure in the pane, which would have a deleterious effect after opening the pressure plates 1, 2, a pressure gauge 25 is provided in the device 5. This pressure gauge 25 permits opening of the pressure plates 1, 2 only after a predetermined pressure has been reached in the interior 14 of the insulating glass unit 4. This pressure can correspond to the atmospheric pressure at the manufacturing site, or can deviate from such pressure in the upward or downward direction. Attainment of the desired pressure in the inner space 14 of the insulating glass unit 4 can be accelerated by providing that, after the feeding of filler gas by way of the device 5 has been interrupted, exhausting of gas by suction from the inner space 14 by the device 6 is continued.

After the desired pressure, which can also deviate from the ambient air pressure, has been established or reached in the inner space 14 of the insulating glass unit 4, the openings in the spacer 8 are sealed by injection of a hardening compound, for example with the aid of a plug of butyl rubber. Sealing of the openings in the spacer can also take place in a further station, in order to shorten the cycle time.

The overhang of the insulating glass unit 4 beyond the edge 24 of the plates 1, 2, illustrated in FIG. 3, amounts under practical condition to about 2–3 mm.

The pressure exerted on the outer surfaces of the glass panes 12 and 13 of the insulating glass unit 4 can be lower or higher or of equal value than and as the pressure built up in the inner space 14 during the filling step. Preferably, the pressure applied by the pressure plates 1 and 2 is at least equal to the pressure in the interior 14 of the insulating glass unit 4 so that the adhesive bond between the spacer 8 and the glass panes 12 and 13 of the insulating glass unit 4 is not stressed. A higher pressure will be applied if flat-pressing of the insulating glass unit. 4 is performed simultaneously with filling the insulating glass unit 4 with filler gas.

What is claimed is:

1. Process for filling an insulating glass unit (4) with a filler gas, wherein the filler gas is introduced at superatmospheric pressure by way of at least one inlet opening into an inner space (14) of the insulating glass unit (4) between two glass panes (12, 13), and air and/or air-gas mixture is exhausted by way of at least one further opening (9) from the inner space (14) of the insulating glass unit (4), characterized in that a pressure is exerted between solid members during the filling step on substantially all of the areas of the outer surfaces of the glass panes (12, 13) of the insulating glass unit (4) to be filled, this pressure being at least of the same magnitude as the pressure in excess of atmospheric pressure in the inner space (14) of the insulating glass unit (4) during introduction of the filler gas.

2. Process according to claim 1, characterized in that the pressure is exerted on the glass panes (12, 13) during the filling step by the application of plate-shaped pressure elements (1, 2) that contact substantially all of the areas of the outer surfaces of the glass panes (12, 13).

3. Process according to claim 1, characterized in that the volume of the inner space (14) of the insulating glass unit (4) to be filled with the filler gas is determined; that the amount of filler gas introduced is detected; and that the filling step is interrupted once the detected amount of filler gas is equal to the amount of filler gas to be filled into the inner space.

4. Process according to claim 3, characterized in that the amount of filler gas fed per unit time is determined, and that the filling step is interrupted once the product of amount of filler gas per unit time and duration of the filling step corresponds to the volume to be introduced into the inner space (14) of the insulating glass unit (4).

5. Process according to claim 1, characterized in that, after termination of the filling step, the pressure is measured in the gas feed conduit, and that the pressure on the outer surfaces of the glass panes (12, 13) of the insulating glass unit (4) is lifted only once the thus-determined pressure corresponds to a preselected value.

6. Process according to claim 1, characterized in that the pressure of the gas in said inner space between the glass panes (12, 13) is brought by said filling step to a preselected value corresponding to mean atmospheric pressure at the installation site of the insulating glass.

7. Process according to claim 6, characterized in that the pressure on the outer surfaces of the glass panes (12, 13) is lifted after the pressure in the inner space (14) of the insulating glass unit (4) has assumed a value corresponding to a mean atmospheric pressure at the installation site of the insulating glass unit (4).

8. Process according to claim 1, characterized in that the filling step is performed with gas flow velocities of up to 200 1/min.

9. Apparatus for filling an insulating glass unit with filler gas, said insulating glass unit comprising two spaced parallel glass panes with an inner space between them and a spacer frame disposed between and spacing apart the glass panes, said spacer frame having at least one opening through which gas can be introduced into the inner space and at least one opening through which gas can be removed from the inner space, said apparatus comprising two pressure plates which, during the feeding of filler gas into said space, can be brought into contact with and pressed against substantially all of the outer surfaces of the glass panes of the insulating glass unit.

10. Apparatus according to claim 9, and means for feeding filler gas through said at least one opening for the introduction of gas, said gas feeding means comprising a probe and means to align the probe to the center of the distance between said glass panes.

11. Apparatus as claimed in claim 9, and means for removing gas from said space between said panes through said at least one opening for removing gas, comprising a probe and means for aligning the probe to the center of the distance between the glass panes.

12. Apparatus as claimed in claim 9, and means for feeding filler gas through said at least one opening for feeding filler gas, said gas feeding means comprising a block which can be applied to an edge of the insulating glass unit, said block having a layer of elastic material on its surface facing the insulating glass unit, said layer coming into sealing contact with end edges of the glass panes and with the outer surface of a said spacer frame so as to prevent loss of gas upon filling the insulating glass unit.

13. Apparatus according to claim 9, and conveying means for the insulating glass unit, said conveying means being disposed at the lower edges of the pressure plates.

14. Apparatus as claimed in claim 9, and means for removing gas through said at least one opening for removing gas, and slide means on which said gas removing means are mounted for vertical and horizontal adjustive sliding movement.

15. Apparatus according to claim 9, and a conduit for feeding filler gas through said at least one opening for feeding filler gas, and a pressure gauge for monitoring the pressure in said conduit.

16. Apparatus as claimed in claim 9, and a conduit for feeding filler gas through said at least one opening for feeding filler gas, a flow meter in said conduit indicating the entire quantity of gas that is passed through said conduit and/or the amount of gas that is passed through said conduit per unit time, and said flow meter transmitting a corresponding signal.

* * * * *